US009938743B2

(12) United States Patent
Rejniak et al.

(10) Patent No.: US 9,938,743 B2
(45) Date of Patent: Apr. 10, 2018

(54) ROBOTIC POOL TILE CLEANER

(71) Applicants: Brian Rosser Rejniak, Yorba Linda, CA (US); John Alan Rejniak, Corona, CA (US)

(72) Inventors: Brian Rosser Rejniak, Yorba Linda, CA (US); John Alan Rejniak, Corona, CA (US)

( * ) Notice: Subject to any disclaimer, the term of this patent is extended or adjusted under 35 U.S.C. 154(b) by 113 days.

(21) Appl. No.: 15/177,211

(22) Filed: Jun. 8, 2016

(65) Prior Publication Data

US 2017/0356211 A1 Dec. 14, 2017

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
See application file for complete search history.

(56) References Cited

U.S. PATENT DOCUMENTS 3,972,339 A * 8/1976 Henkin ..... E04H 4/1654 134/168 R
5,617,600 A * 4/1997 Frattini ..... E04H 4/1654 15/1.7
2013/0081656 A1* 4/2013 Gopalan ..... A47L 9/1427 134/21

* cited by examiner

*Primary Examiner* — Randall Chin
(74) *Attorney, Agent, or Firm* — CIONCA IP Law P.C.

(57) ABSTRACT

A robotic swimming pool tile cleaner having a bottom section, an upper section, a fore side, an opposite aft side, a port side and an opposite starboard side, the bottom section having a propeller housing adapted to house a plurality of thrusters being configured to provide forward thrust to the robotic tile cleaner, assist in turning the robotic tile cleaner in a corner of a swimming pool by providing a turning thrust to move the fore side of the robotic tile cleaner away from a swimming pool wall facing the fore side, and to provide side thrust to push the robotic tile cleaner against a swimming pool tile wall facing the port side, and a plurality of cleaning brushes mounted vertically on the port side of the upper section and being configured to touch the swimming pool tile wall and to move during operation of the robotic tile cleaner.

19 Claims, 18 Drawing Sheets

ROBOTIC POOL TILE CLEANER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF INVENTION

1. Field of the Invention

The invention relates generally to pool cleaning apparatus, systems and methods and more particularly to apparatus, system and method for automatic cleaning of pool tiles.

2. Description of the Related Art

Many variations of robotic swimming pool cleaners are available on the market. Most have cord or hose tethers, and some claim to clean swimming pool wall tiles as well. In consumer reviews a number of cons are reported in the overall performance of robotic swimming pool cleaners. The main problem is that the majority of them is not efficient in swimming pool tile cleaning.

Thus, there is a need for a new and improved robotic swimming pool tile cleaner that is efficient in cleaning pool tiles.

After many years of field experience in the pool service industry, it has been determined that most pool service companies don't properly clean tiles in their customer service stops. Moreover, many DIY swimming pool owners clean their own pools, and fail the brush the tiles on a regular basis. This results in discoloring of the tiles with oxidation building up over time.

Swimming pool water lines tend to attract dirt and calcium leaving an undesirable dirty unsightly "water line". Tiles should be cleaned weekly to prevent calcium build up and dirt formation. If pool tiles are not cleaned weekly or bi-weekly, not only would the tiles stop being aesthetically pleasing to look at, it will cost the consumer $400-600 every few years by having to call in a company who specializes in pool tile cleaning, which is harsh and abrasive and over time will degrade the sheen and integrity of the pool tiles.

Thus, there is a need for a new and improved robotic swimming pool tile cleaner that makes it easy for pool owners to clean the tiles of their pools.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In some aspects, a robotic swimming pool tile cleaner is provided having a bottom section, an upper section extending upwards of the bottom section, a fore side, an opposite aft side, a port side and an opposite starboard side, the bottom section having a propeller housing adapted to house a first, a second, and at least a side thruster, all thrusters being configured to discharge water away from the propeller housing, the first thruster being positioned in an outer aft corner of the propeller housing to provide forward thrust to the robotic swimming pool tile cleaner, the second thruster being positioned in an opposite inner fore corner of the propeller housing and being configured to be turned on when the robotic swimming pool tile cleaner is in a corner of a swimming pool and thus assist in turning the robotic swimming pool tile cleaner therein by providing a turning thrust for moving the fore side of the robotic swimming pool tile cleaner away from a swimming pool wall facing the fore side, the first and second thrusters being mounted at a set angle in relation to an axis of the robotic swimming pool tile cleaner extending from the aft side to the fore side, the at least a side thruster being positioned in the starboard side to provide thrust for pushing the robotic swimming pool tile cleaner against a swimming pool tile wall facing the port side.

The above aspects or examples and advantages, as well as other aspects or examples and advantages, will become apparent from the ensuing description and accompanying drawings.

BRIEF DESCRIPTION OF THE DRAWINGS

Elements in the figures have not necessarily been drawn to scale in order to enhance their clarity and improve understanding of these various elements and exemplary embodiments of the invention. Furthermore, elements that are known to be common and well understood to those in the industry are not depicted in order to provide a clear view of the various exemplary embodiments of the invention, thus the drawings are generalized in form in the interest of clarity and conciseness. For exemplification purposes, and not for limitation purposes, aspects, embodiments or examples of the invention are illustrated in the figures of the accompanying drawings, in which.

DETAILED DESCRIPTION

Figure 1:
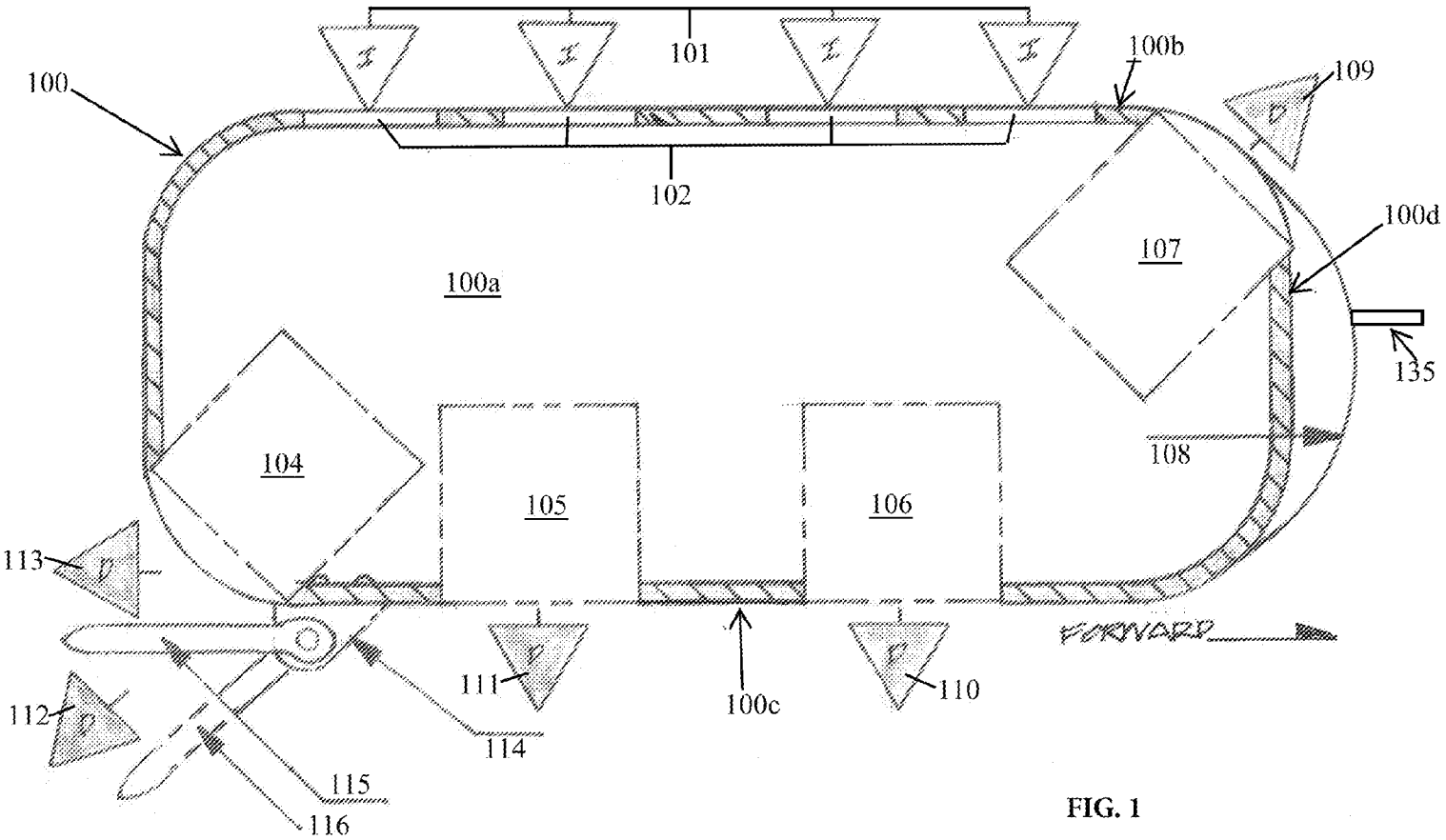
FIG. 1 illustrates a top view of a propulsion system of a robotic swimming pool tile cleaner, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

For the following description, it can be assumed that most correspondingly labeled elements across the figures (e.g., 104 and 204, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates a top view of a propulsion system of a robotic swimming pool tile cleaner, according to an aspect. The propulsion system may be housed into or associated with a propeller housing 100 and may include a plurality of propellers/thrusters 104-107, a plurality of inlets 102, and a rudder/deflector 115. It should be noted the propellers/thrusters positions 104-107 within the inside submersible cavity 100*a* of the propeller housing 100. As an example, four propellers/thrusters may be provided in the cavity 100*a* of the propeller housing 100, which, in an example, may be the bottom section of the robotic pool cleaner disclosed herein. For example, non-metallic fabricated or molded cylindrical propeller/thruster mounts may be used (see FIG. 4 for example, suggesting the cylindrical shape).

In the example shown, two thrusters 105-106 are located on the right (starboard) side 100*c* of the propeller housing 100 to provide discharge flows 111 and 110 and thus thrust to push the robotic tile cleaner against the swimming pool tile (not shown) located on the opposite side, facing the left (port) side 100*b* of the propeller housing 100. This action may maintain equal and/or constant pressure to keep a plurality of cleaning brushes (described later), on the tile, to ensure constant cleaning brush contact with the tile.

In an example, the fore thruster 107 and the aft thruster 104 may be installed at about a 45-degree angle, as shown. The forward propeller/thruster mount 107 may be placed on the left (port) side 100*b*, fore side, or in the front-left corner of the propeller housing 100 as shown in FIG. 1. The aft propeller/thruster mount 104 may be placed on the right (starboard) side 110*c*, aft side, or in the right-back corner of the propeller housing 100. For forward motion (i.e., left to right in FIG. 1), the aft propeller/thruster 104 can be used to provide discharge flow 113 and thus push the robotic pool tile cleaner forward. For turning into a perpendicular corner for example, the fore and aft propellers may be used simultaneously, while the starboard thrusters 105-106 are preferably turned off during turning. In FIG. 1, turning means causing the fore side 100*d* to be angling and eventually facing the bottom of the page (if the corner if of 90 degrees).

A sensor 135, such as a wobble stick type micro switch, or similar sensing device, may be provided to detect a swimming pool corner (e.g., a perpendicular corner). This will typically cause the stopping of the robotic tile cleaner, then subsequently the turning on the fore 107 and aft 104 thrusters, which, again, are inset in the example shown at about a 45-degree angle. The approximately 45-degree angle setup of the fore thruster 107 may have the benefit of enabling associated discharge flow 109 to cause the robotic cleaner to move simultaneously away from both, the side tile wall of the pool (not shown) facing the port side 100*b* and also the front tile wall (not shown) facing the fore side 100*d*, thus easing the turning of the robotic cleaner. Similarly, the about 45-degree setup of the aft thruster 104 and its associated discharge flow 112 helps push the robotic cleaner forward and, simultaneously, towards the side tile wall (not shown), thus facilitating the turning of the robotic cleaner. It should be noted that the push towards the side tile wall effect of the aft thruster 104 also enhances the push provided by the starboard thrusters 105-106, thus increasing the effectiveness of the cleaning provided by the plurality of brushes described later herein.

It should be noted that while the aft and fore thrusters 104, 107 have the 45-degree setup in relation to the longitudinal axis of the propeller housing 100, as described hereinbefore, they are not coaxial. It should be appreciated that the non-coaxial configuration facilitates the steering/turning of the robotic pool tile cleaner. It should also be understood that deviation from the 45-degree angle (e.g., 40 degrees) may be permissible. Still, it is believed that the 45-degree setup is optimum for enabling the turning of the cleaner apparatus.

As shown in FIG. 1, a rudder/deflector (115-normal position and 116-turning position) may optionally be provided. The rudder may be pivotally associated with the propeller housing 100 via a bracket 114. In normal position 115 of the rudder, as shown, the discharge flow 113 of the aft thruster 104 may be forced to provide mostly forward push. In turn position 116 of the rudder, the discharge flow 112 of the aft thruster 104, can provide forward push as well as side push to assist with the turning of the robotic pool cleaner as described hereinbefore.

Again, as stated earlier, in turning mode, the starboard propellers/thrusters 105-106 are preferably programmed to be "off", to ease up the turning of robotic pool tile cleaner. It should be noted the discharge flow arrows 109-113 and the inlet flow arrows 101 on the left (port) side 100*b* of the robotic tile cleaner bottom section, indicating the direction of the respective flows. The inlet flows 101 will flow through the plurality of inlets 102 into the bottom section/propeller housing 100, to provide the necessary water to thrusters 104-107.

A forward curved bumper 108 may be provided to assist in hydrodynamics, namely with stability in the fore section and to minimize some resistance of water flow around the fore section of the robotic pool tile cleaner.

In the manufacture of the bottom section 100, mounting fastener receptacles (not shown) may need to be molded or fabricated into the wall (hull) of the bottom section 100 to secure the top section (described later) in place.

Figure 2:
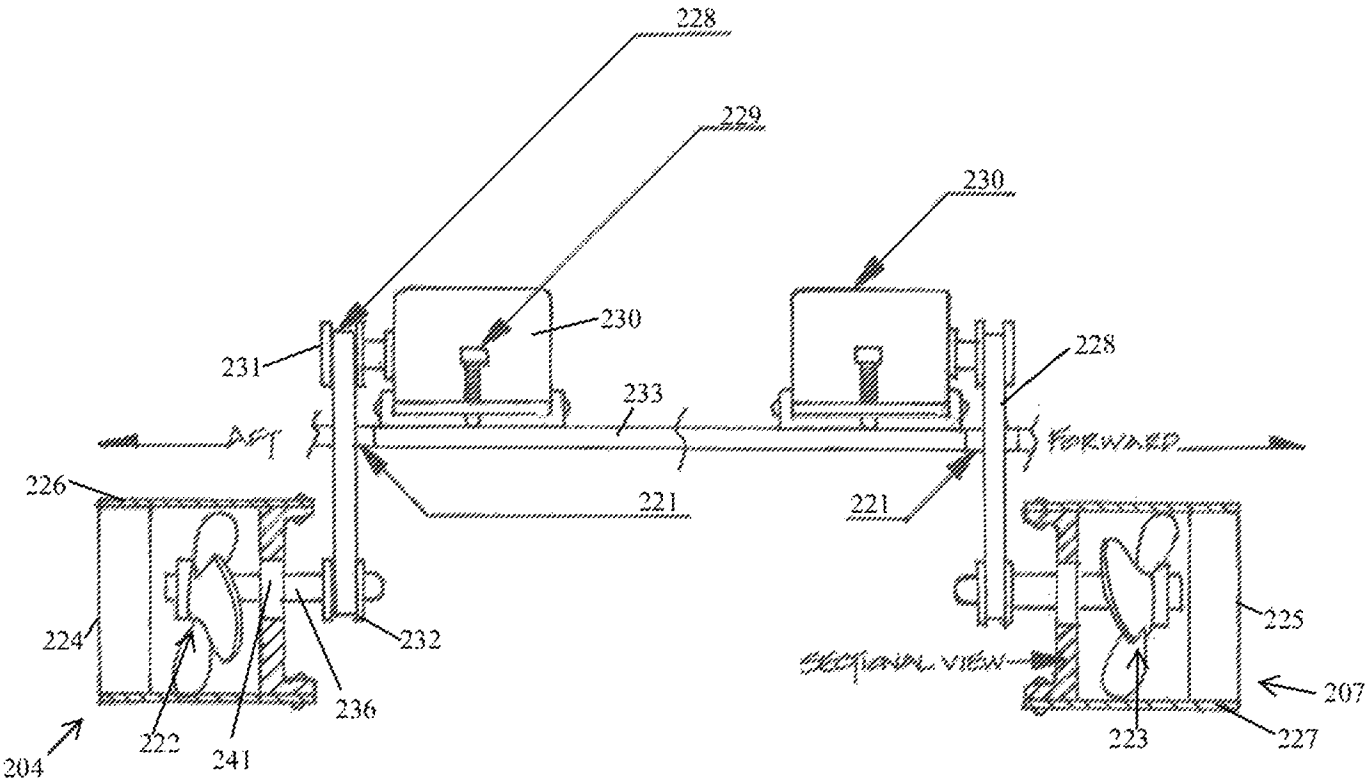
FIG. 2 illustrates a side view of the aft (stern) and the forward (fore or bow) thrusters from FIG. 1, according to an aspect.
Figure 3:
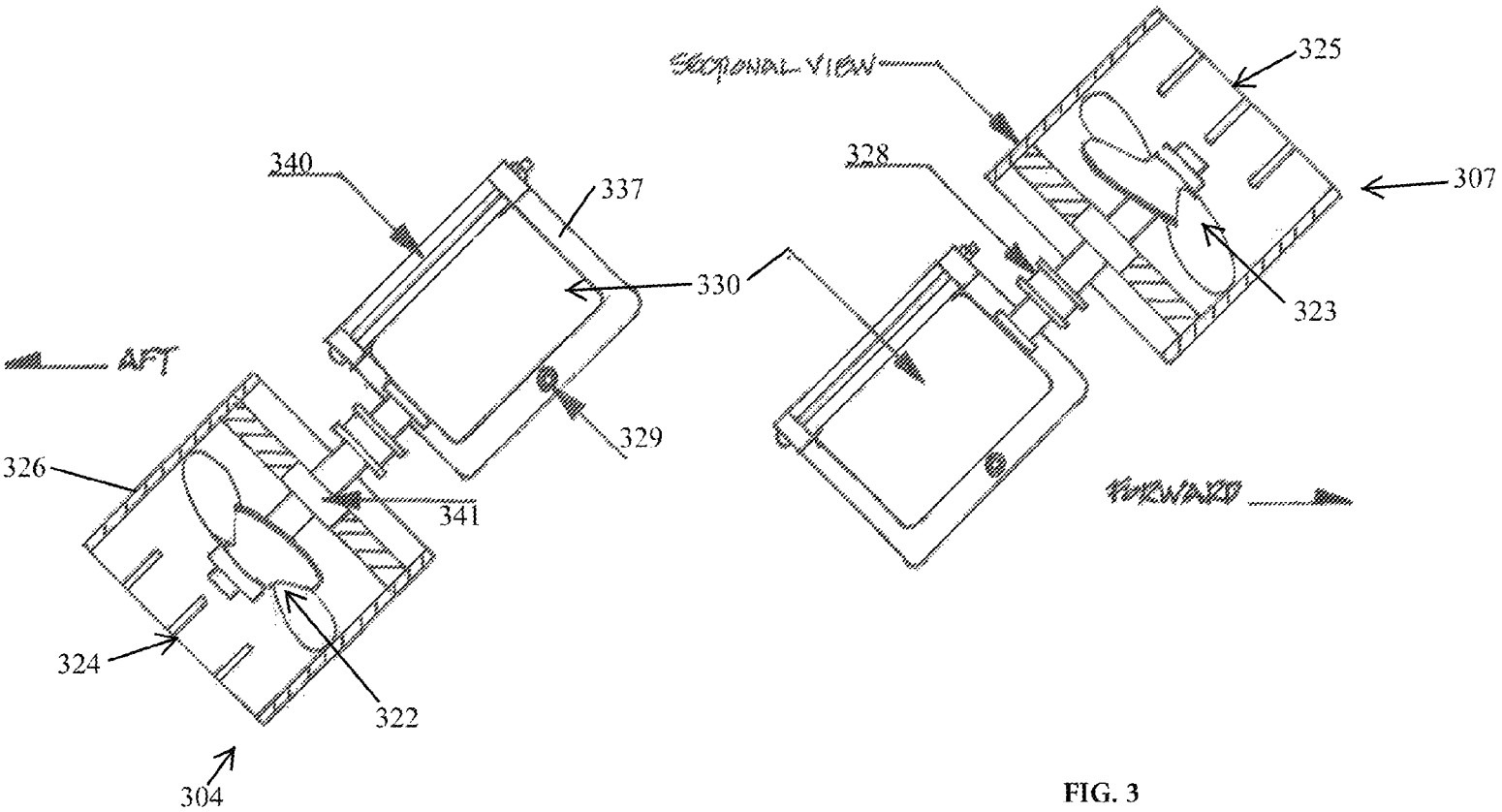
FIG. 3 illustrates a top view of the aft and forward thrusters from FIG. 2, according to an aspect.

FIG. 2 illustrates a side view of the aft (stern) and the forward (fore or bow) thrusters from FIG. 1, according to an aspect. FIG. 3 illustrates a top view of the aft and forward thrusters from FIG. 2, according to an aspect. The side view from FIG. 2 is similar to the top view illustration from FIG. 3, but is not drawn at a 45-degree angle as in FIG. 3, for better clarity. It should be noted that the cylindrical sectional view of thruster mounts (e.g., 226, 326) is similar in the side and the top views. Looking at the aft thruster assembly 204 in FIG. 2 side view drawing, it is shown the timing belt 228 in place, the upper motor shaft timing belt pulley 231 the motor 230 and belt tensioner 229. Under the top plate 233 in the bottom submerged section of the robotic pool tile cleaner, the aft thruster timing belt pulley 232, thruster shaft 236, bearing housing 241 and propeller 222 are seen in a side view. As shown, the motor shaft pulley 231 is in alignment with the thruster shaft pulley 232. A belt tensioner 229 may be provided to adjust the tension in belt 232 as needed for proper operation of the robotic pool tile cleaner. In an example, a belt tensioner mechanism may include the motor mount plate 337 pivotally associated with the top plate 233 at one end (see swivel end 340, 440) and a belt tensioner 229, 329, 429, which may be a hex cap fastener as shown, threadably engaged with motor mount plate 337, such that twisting of the bolt can cause for example an increase in the gap between motor mount 337 and top plate 233 in order to increase the tension in belt 228. For safety, finger guard vanes 224, 324 are preferably provided at the discharge end of thruster cylindrical mount 226, 326. As shown, the fore thruster assembly 207 has similar components and configuration.

It should be noted that the top plate 233 needs to allow the passage of belt 228, so that power can be transmitted from motor 230 to propeller 222. In an example, this can be accomplished by providing opening slots 221 at each end of the top plate 233.

Figure 13:
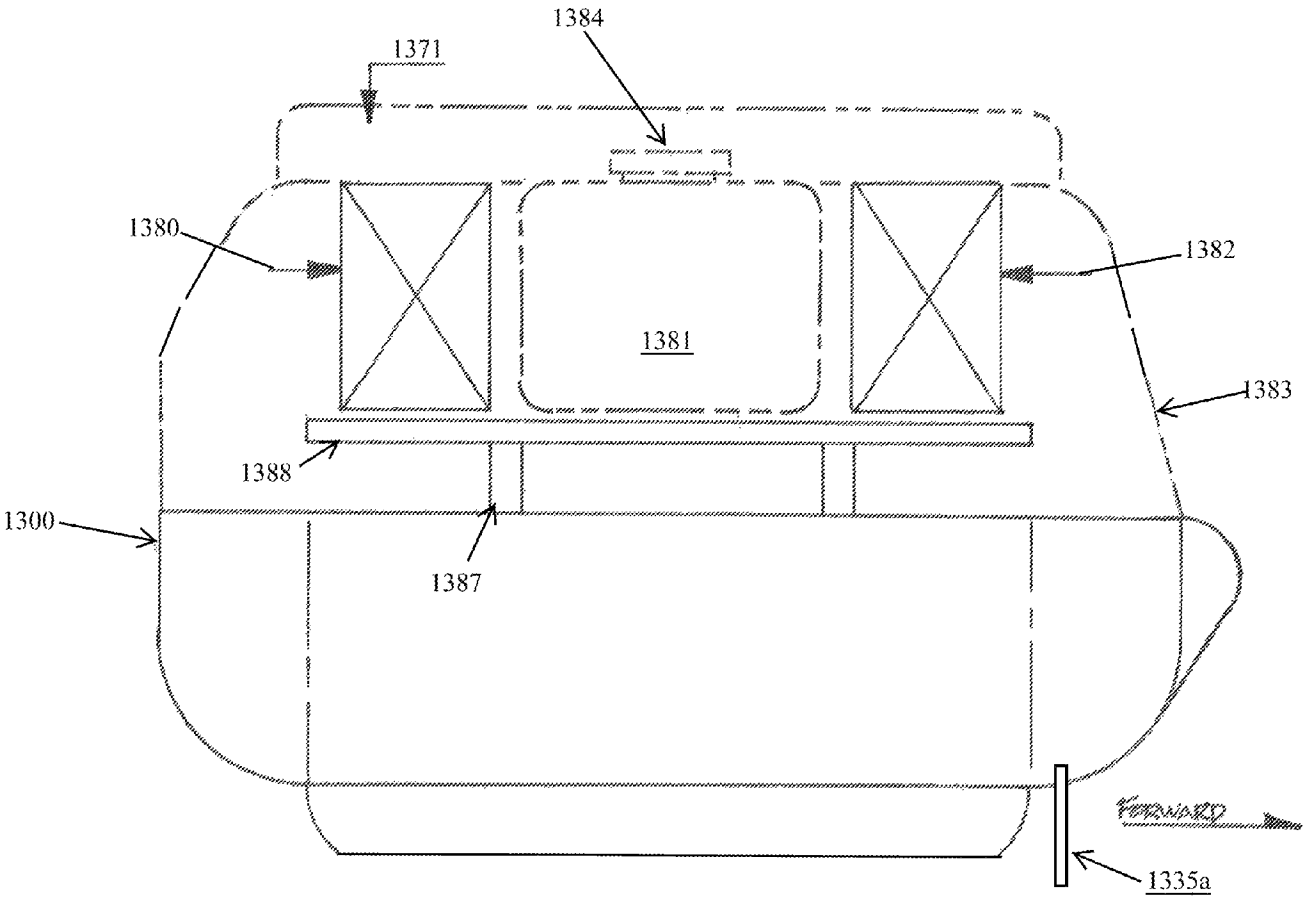
FIG. 13 illustrates a right side (starboard) view of equipment placed on an upper level of the pool tile cleaner, according to an aspect.

A molded or fabricated removable water splash cover is not shown in either drawing, for clarity (see the cover at 1383 in FIG. 13). The cover may be needed to eliminate water splashing onto for example the motors 230 and top plate 233. An access panel (not shown) will be required and integrated into the top plate to access the timing belts and timing belt tensioners (if installed below top plate 233) for assembly and replacing of timing belts.

The motors 230, 330, 430 used to drive the thrusters may be for example 12 Volt DC drive motors. The maximum wattage for the thruster drive motor at 12 Volts DC may be 55 watts @3,000 RPM. Lesser wattage motors and various RPM's are available and may be used. The minimum wattage required may be 24 watts at 12 Volts DC. Any wattage in between may be used, depending on manufacturer source and availability.

Again, using a swivel end 340 of motor mounting plate 337 with a belt tensioner adjustment hex cap fastener 329 on the opposite end can facilitate timing belt tensioning, as described hereinbefore. Alternatively, as an another example, an idler pulley (not shown) may be used as a belt tensioner, as known. Such timing belt tensioner may be installed unto a slotted bracket to facilitate moving the tensioner to the proper belt tension.

Figure 4:
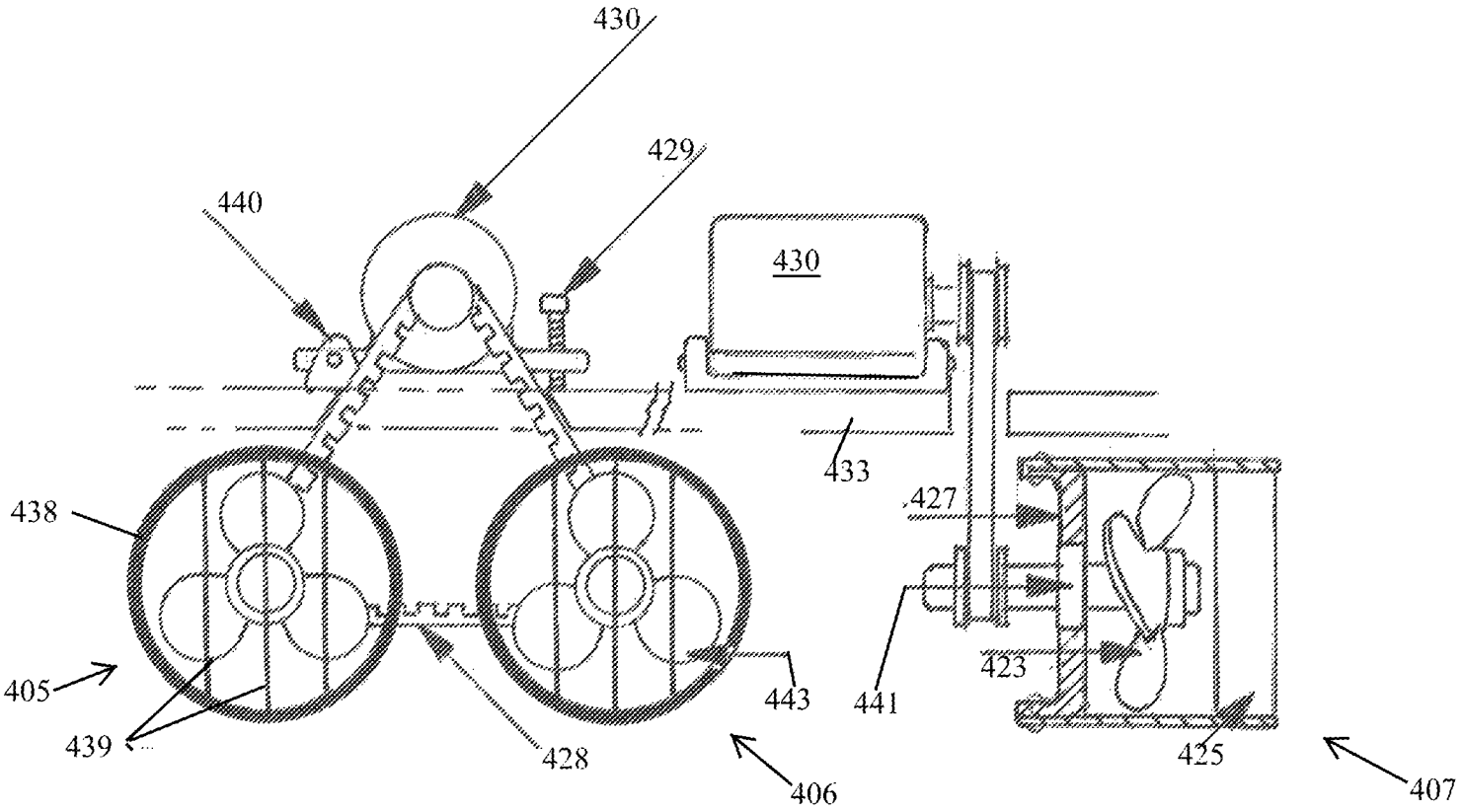
FIG. 4 illustrates a partial right side (starboard) view of the propulsion system of the robotic swimming pool tile cleaner from FIG. 1, showing the front view of the starboard thrusters and the side view of the fore thruster, according to an aspect.

FIG. 4 illustrates a partial right side (starboard) view of the propulsion system of the robotic swimming pool tile cleaner from FIG. 1, showing the front view of the starboard thrusters and the side view of the fore thruster, according to an aspect. Again, the fore thruster 407 has similar components and configuration as the aft thruster, which was described in detail hereinbefore when referring to FIGS. 2-3. As shown, the starboard thrusters have similar components and configuration as well. In the example shown, however, it should be noted that a single motor 430 and a single timing belt 428 may be used to drive more than one starboard thruster (two thrusters in this example, and both mounted perpendicularly to the starboard side, as an example). This configuration, using a single motor, at minimum, may save manufacturing costs.

All propellers are preferably driven using a timing belt (see 428, the belt for the starboard propellers) with the same pitch timing belt pulleys installed on the propeller shaft and motor shaft.

As shown, the starboard thruster assemblies 405, 406 also have finger guards 439 in place. Again, the thruster mounts may be cylindrical (see 438 for example) and they me configured to receive respective propellers (see 443 for example). In an example, the propellers may have approximately 3 inches as outside diameter. Other sizes may be used, depending in part on the finished size of the final cylindrical thruster mounts.

Non-metallic material would be most suitable for propellers. Marine and swimming pool accessory equipment propellers are readily available on the market in various plastics. 316 stainless steel propellers are suitable for this application, albeit, they are pricey.

Figure 5:
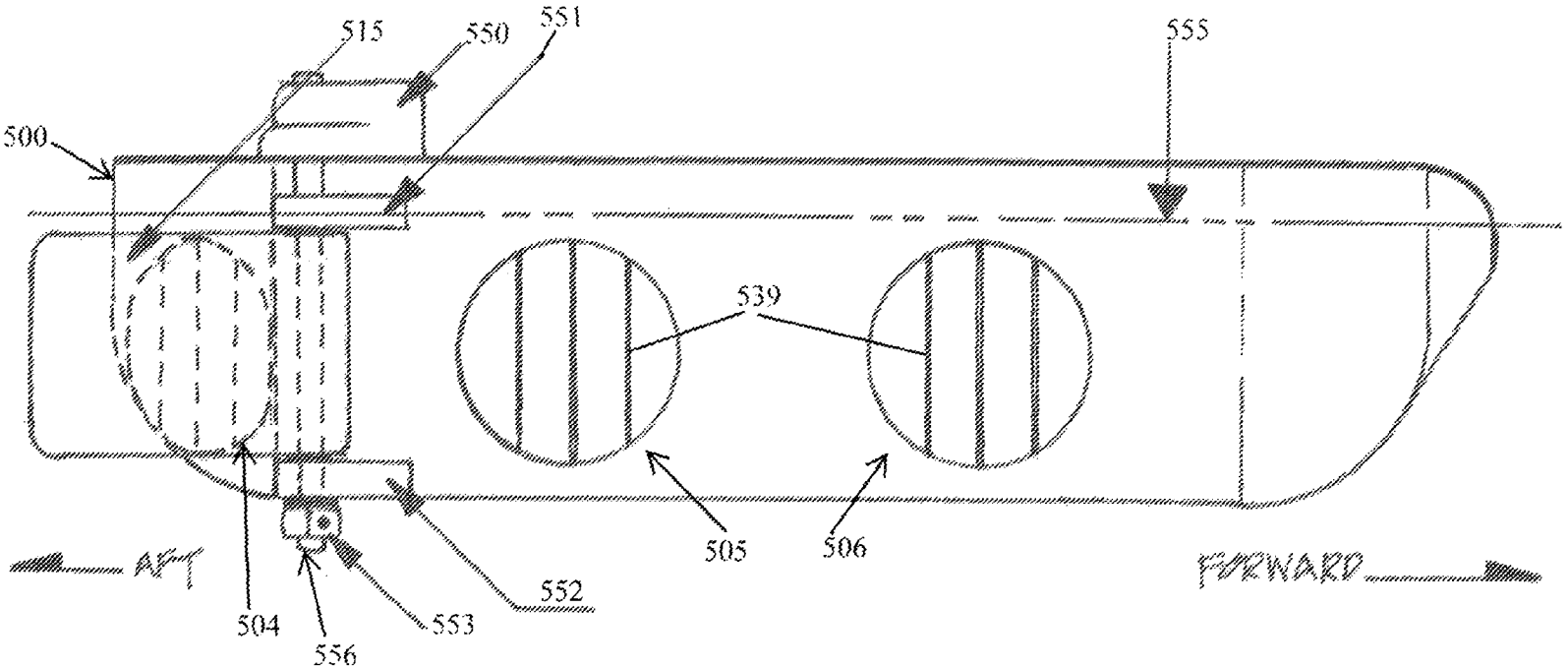
FIG. 5 illustrates a starboard side view of a bottom section of the robotic pool tile cleaner, according to an aspect.

FIG. 5 illustrates a starboard side view of a bottom section of the robotic pool tile cleaner, according to an aspect. The bottom section 500 is also referred to as the propeller housing, as stated earlier. The approximate exemplary location of side (starboard) facing propellers 505, 506, also referred to as thrusters, is shown. The propeller housing 500 will preferably have provisions for installation of non-removable, burr free finger guards 539. Again, as described when referring to FIG. 1, the starboard facing propellers provide thrust to push the robotic tile cleaner consistently flush with the swimming pool tile wall.

Again, in an example, the propeller housing (see 438 for example) outside diameter is no less than 3 inches. Various mounting features may be used to include but not be limited to schedule 40 or schedule 80 PVC, CPVC, plastic pipe, prefabricated solid molded mounts, including any other type of non-metallic material suitable for submersion.

The propeller housing 500 may be non-metallic, molded or fabricated having minimum 0.140" (inches) wall thickness. The non-metallic material may be PVC or various rigid plastics suitable for immersion. If molded, a mid section internal rib frame, approximately 0.125"×0.25" minimum, 0.25"×0.25" maximum for example, may be added for additional strength. Preferred color is blue/cyan to match pool water color.

Also shown in FIG. 5 is the aft propeller/thruster 504, which, again, is installed at about a 45-degree angle, in an example as described hereinbefore. The optional rudder/deflector 515 is also shown, which, again, may be used to divert the flow more aft directional, for increased forward movement, as described hereinbefore. The rudder 515 may be attached to a rudder shaft 556 associated pivotally with propeller housing 500 using top shaft bracket 551, bottom shaft bracket 552, a locking collar 553 and shaft spacers. A servomechanism 550 may be provided for pivoting the shaft 556 and thus rudder 515 as necessary (see 115 and 116 in FIG. 1 and associated description). The function of the rudder, thrusters and all other elements of the pool tile cleaner performing a function will be controlled by a control circuit described hereinafter.

A phantom water line 555 is shown in FIG. 5. This would be a water line target for the bottom section 500. This is because the propellers/thrusters have to be fully immersed at all times for maximum efficiency.

Figure 6:
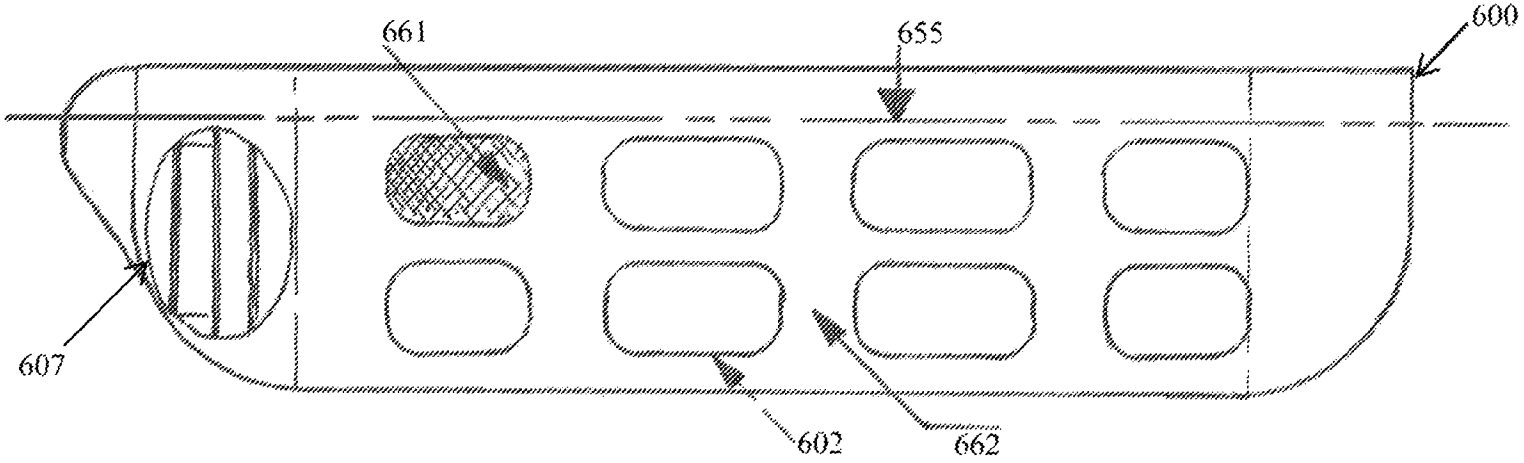
FIG. 6 illustrates a left side (port) view of the bottom section of the robotic pool tile cleaner, according to an aspect.

FIG. 6 illustrates a left side (port) view of the bottom section of the robotic pool tile cleaner, according to an aspect. As shown, the water inlets 602 (102 in FIG. 1) may be cut with corner radiuses to prevent cracking, or molded in. While various manufacturing methods may be employed, the water inlets 602 are cut or molded in a way not to weaken the bottom section hull wall 662 strength. Another option may be to relocate a section of the inlets into the bottom section (seen in FIGS. 7-8) between the pontoon style floats, thus reducing the overall side inlets to for example four. It should be noted also that a screen 661 may be provided on each inlet 602 to prevent debris from entering the inside of the propeller housing 600.

The drawing is not to scale, but as drawn, the eight water inlets 602 provided as an example will provide an ample amount of water for the bottom section-propeller housing 600.

Mounted in the forward section is the forward (fore) mounted propeller/thruster 607 used in conjunction to turning the robotic tile cleaner as described earlier when referring to FIG. 1. The target water line 655 should be noted again. This would ensure complete submerging of all water inlets 602 for maximum efficiency.

Figure 7:
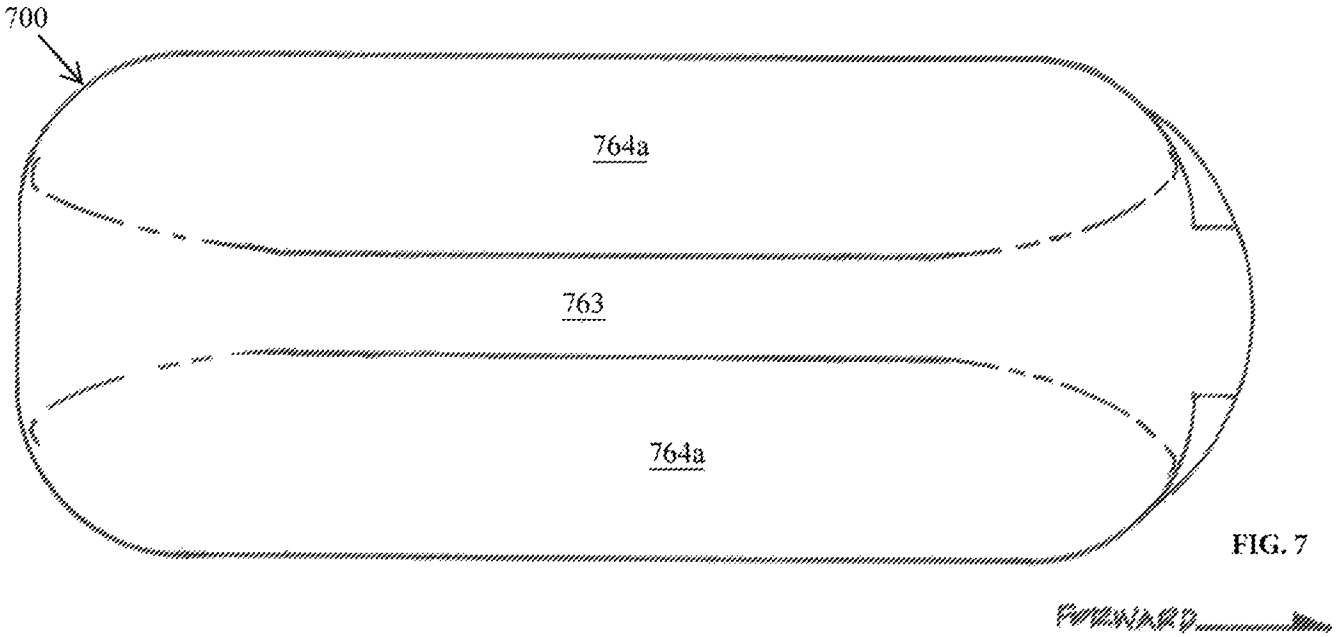
FIG. 7 illustrates an example of a bottom configuration of the robotic pool tile cleaner, according to an aspect.
Figure 8:
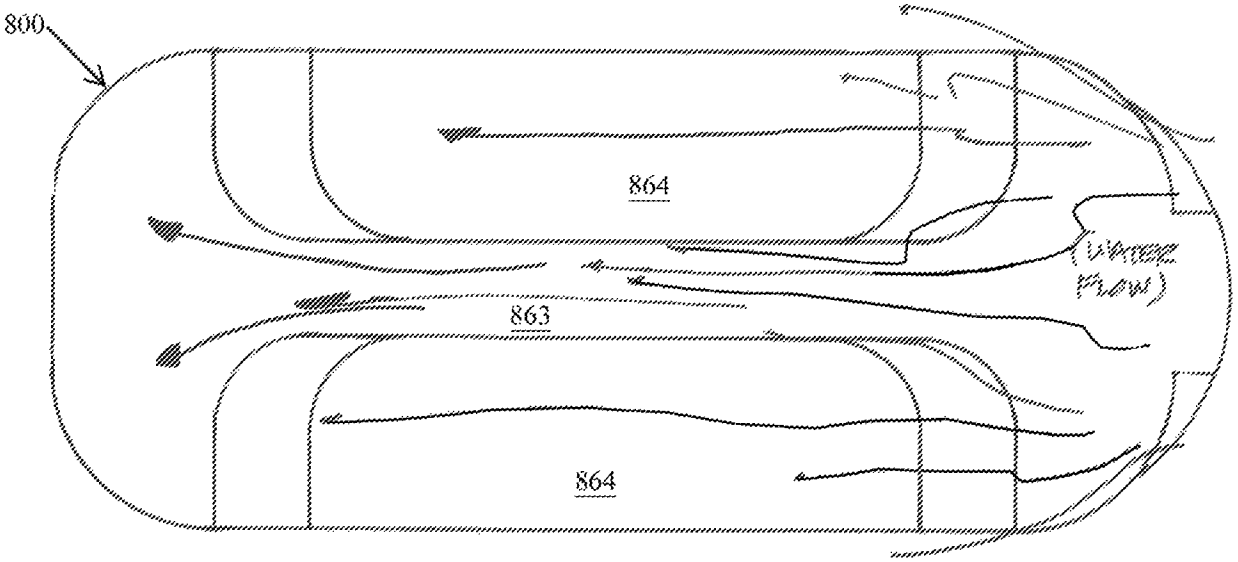
FIG. 8 illustrates another example of a bottom configuration of the robotic pool tile cleaner, according to an aspect.
Figure 9:
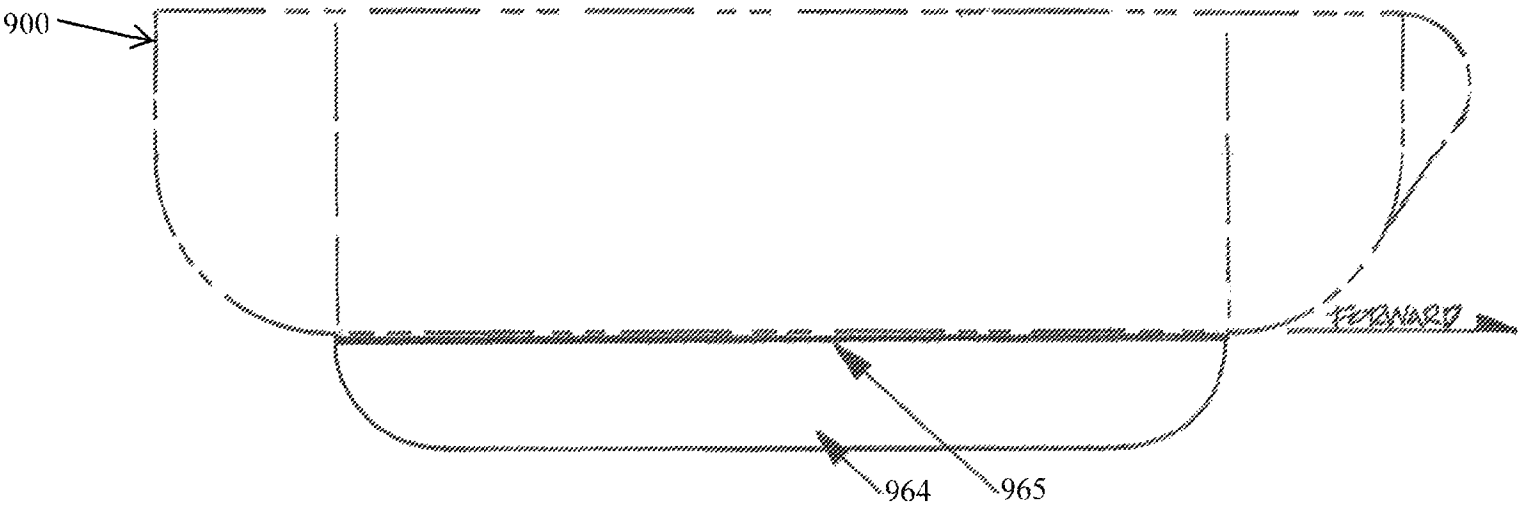
FIG. 9 illustrates a right side view of the bottom configuration from FIG. 8.
Figure 10:
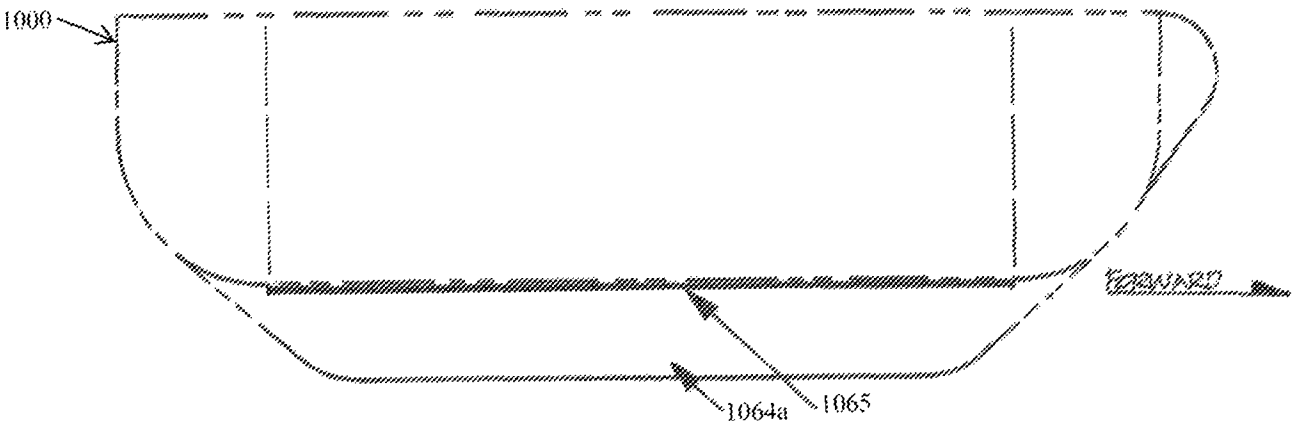
FIG. 10 illustrates a right side view of the bottom configuration from FIG. 7.

FIG. 7 illustrates an example of a bottom configuration of the robotic pool tile cleaner, according with an aspect. FIG. 8 illustrates another example of a bottom configuration of the robotic pool tile cleaner, according with an aspect. FIG. 9 illustrates a right side view of the bottom configuration from FIG. 8. FIG. 10 illustrates a right side view of the bottom configuration from FIG. 7.

The bottom floats, 764*a*, 864, may be integrated into or attached to the bottom section 700, 800 for floatation and stability to the immersed bottom section. They may be "pontoon" style with angled fore and aft sections to provide hydrodynamic stability. The middle section 763, 863 acts as an inverted stabilizer to minimize excessive pitch and yaw characteristics.

As shown in FIGS. 7-8, the outboard sections of bottom floats 764*a*, 864 are flush with the left (port) and right (starboard) sides of the bottom section 700, 800, and also of the top section, to assist in stability and to minimize excessive rolling. This configuration also ensures that the bottom floats or bottom and top sections do not impair the cleaning brushes' overhang (see FIG. 11).

Removable filler caps (not shown) into the floats 764*a*, 864 are recommended to add ballast, if necessary. Ballast may be water or fine white sand. The reasoning for the recommendation is that during experimental demonstrations, sealed floats (pontoons), were added to the bottom of a submersible platform. The platform did not submerse due to the fact that adequate weight was not present on top of the platform. Filling the sealed floats with equal amounts of water, approximately ¾ full, provided ample weight to submerse the platform where the propellers will be housed. The platform floated to the correct water line as intended with propeller housing flooded. Three inch holes were bored into the plastic platform for experimental purposes.

It should be noted that in the side view drawings (FIGS. 9-10) a gasket sheet 965, 1065 is shown presuming the floats are attached to the propeller housing 900, 1000 using fasteners to secure the floats 964, 1064*a*. The floats may be molded to the propeller housing as a one-piece assembly.

It should be noted that the floats are drawn with radius lines in FIG. 9, but may be modified to a steeper angle as in FIG. 10, similar to the bottom of a twin hull boat.

Observing the right side view floats, it should be noted that a continuous angle of continuity may join the floats to forward and aft sections of the propeller housing 100, as shown in FIG. 10.

Figure 11:
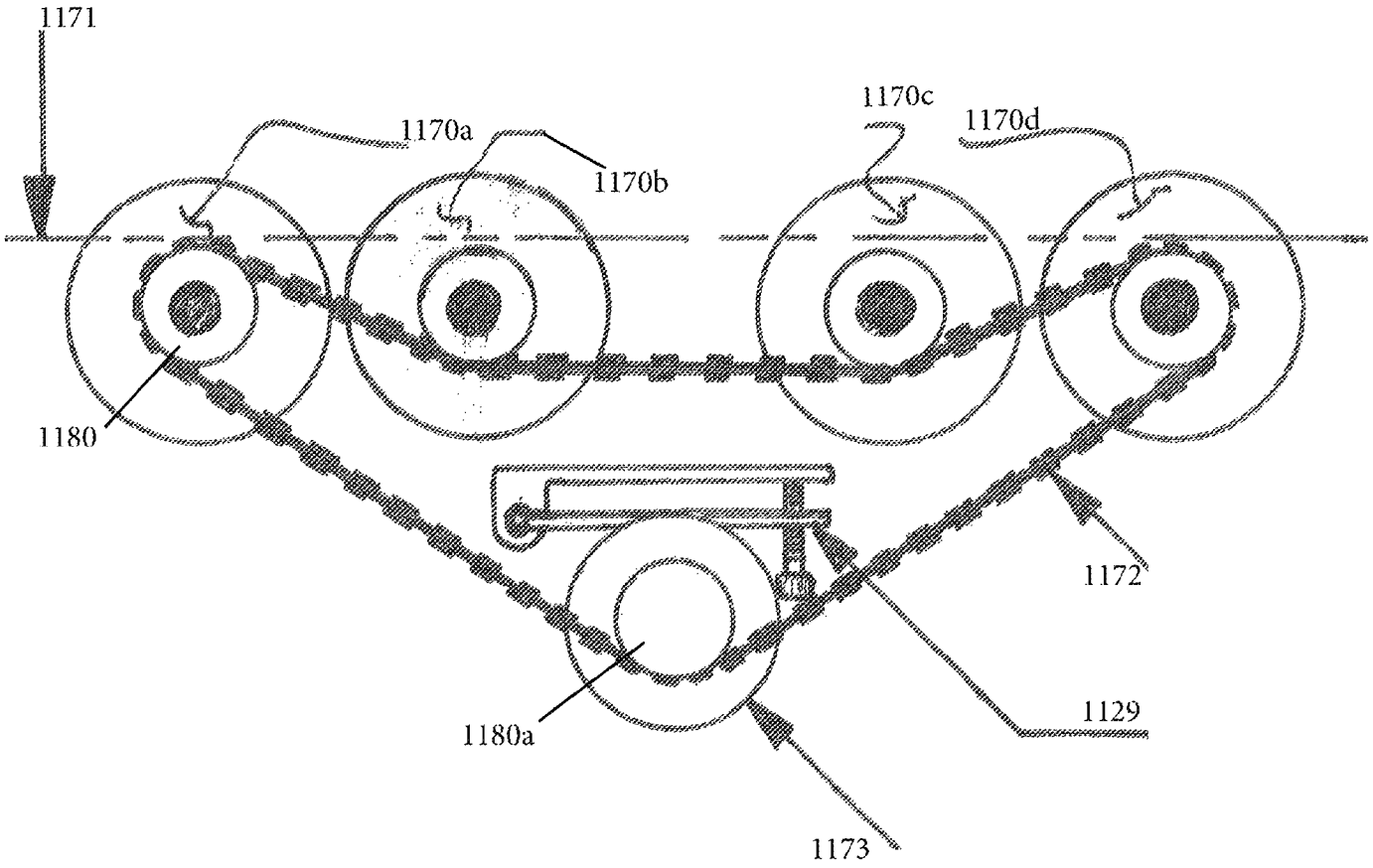
FIG. 11 illustrates a top view of an example of a cleaning brushes assembly of the robotic pool tile cleaner, according to an aspect.
Figure 12:
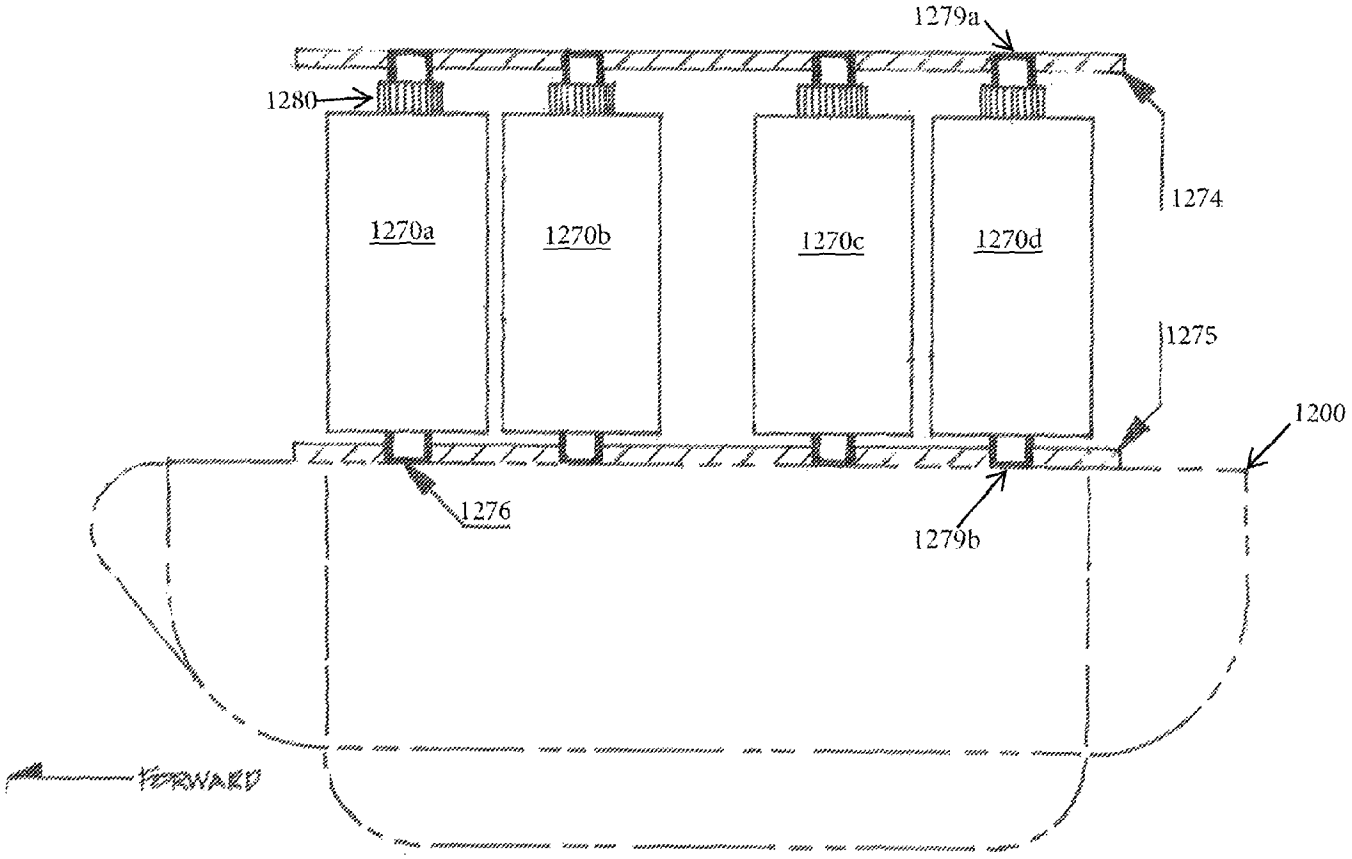
FIG. 12 illustrates a left side (port) view of the cleaning brushes assembly from FIG. 11.
Figure 16A:
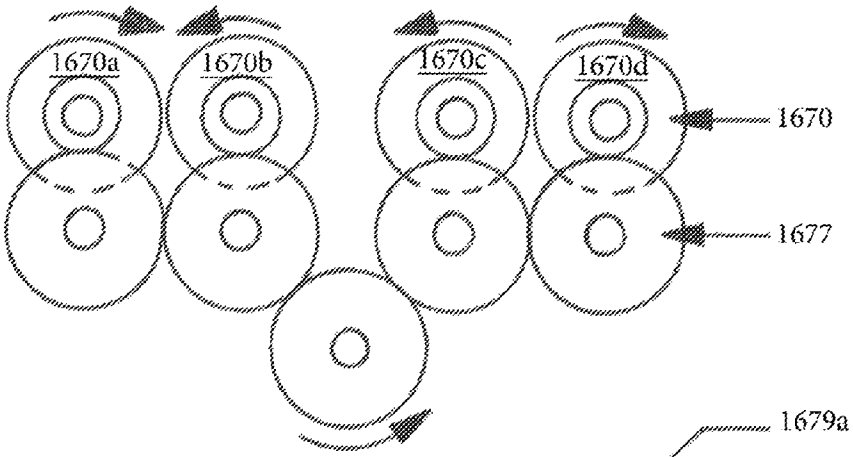
FIG. 16*a* illustrates a top view of another example of a cleaning brushes assembly of the robotic pool tile cleaner, according to another aspect.
Figure 16B:
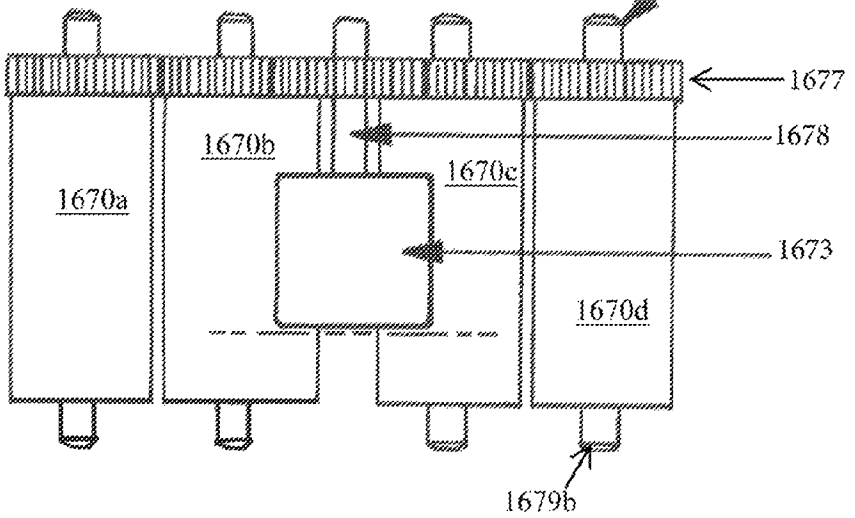
FIG. 16*b* illustrates a left side (port) view of the cleaning brushes assembly from FIG. 16*a*.
Figure 17:
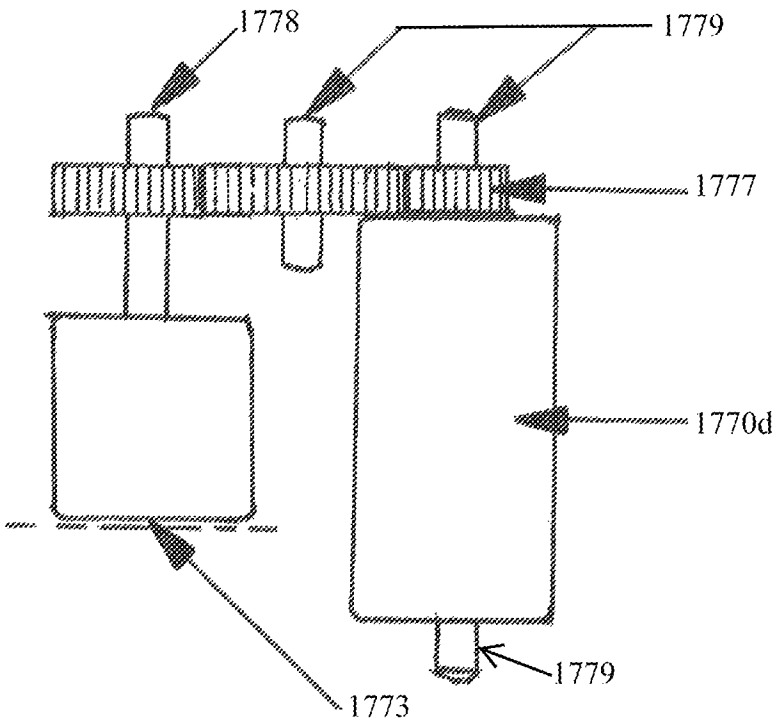
FIG. 17 illustrates a front view of yet another example of a cleaning brush assembly of the robotic pool tile cleaner, according to another aspect.
Figure 18:
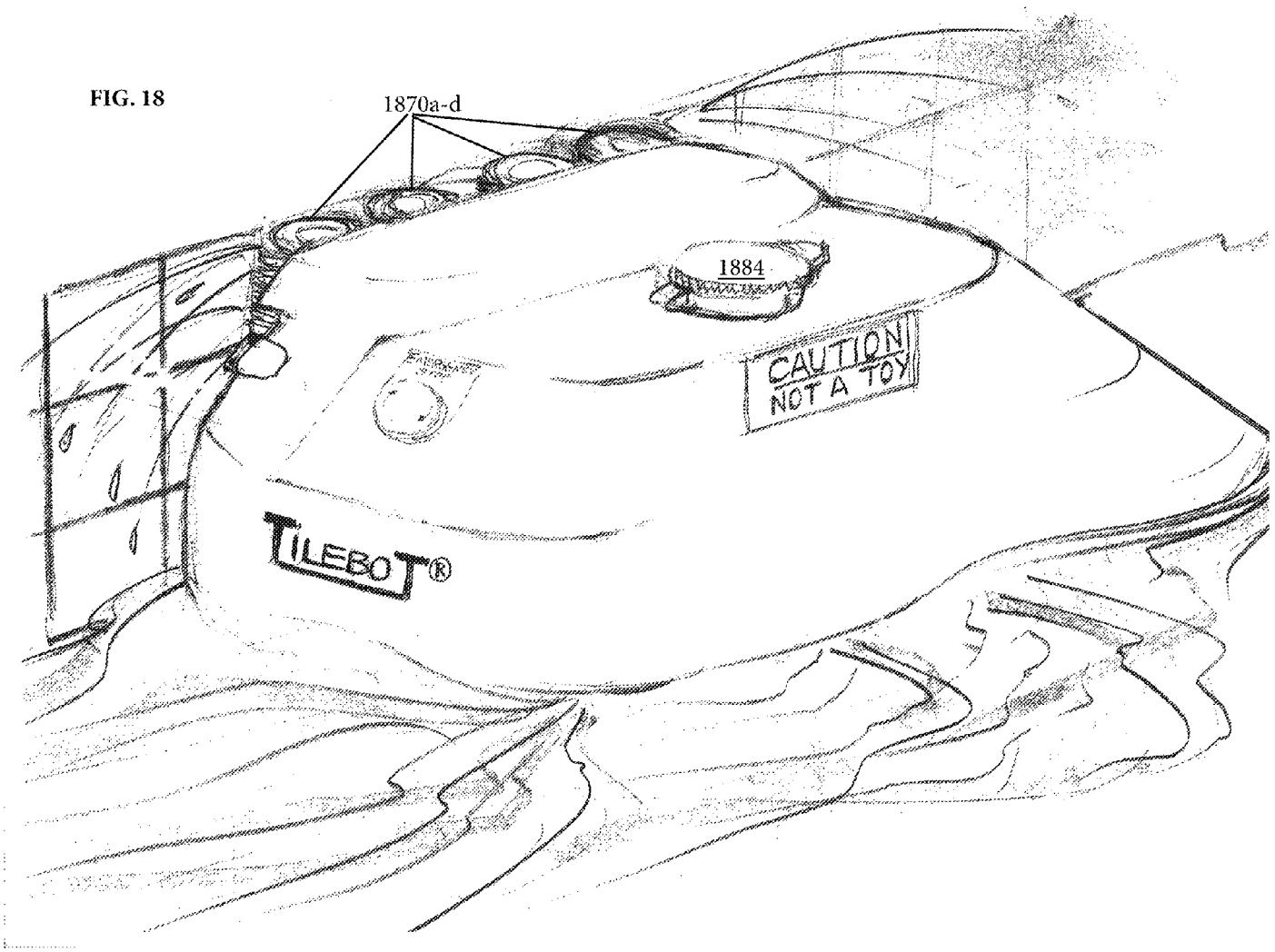
FIG. 18 illustrates a conceptual rendering of a robotic swimming pool tile cleaner.

FIG. 11 illustrates a top view of an example of a cleaning brushes assembly of the robotic pool tile cleaner, according to an aspect. FIG. 12 illustrates a left side (port) view of the cleaning brushes assembly from FIG. 11. FIG. 16*a* illustrates a top view of another example of a cleaning brushes assembly of the robotic pool tile cleaner, according to another aspect. FIG. 16*b* illustrates a left side (port) view of the cleaning brushes assembly from FIG. 16*a*. FIG. 17 illustrates a front view of yet another example of a cleaning brush assembly of the robotic pool tile cleaner, according to another aspect.

On the port side of the robotic pool tile cleaning apparatus, a plurality of cleaning brushes may be provided. In the example depicted in the figures (e.g., FIG. 11), four cleaning brushes 1170*a-d* are shown. Any other number of brushes may be used, however, including one, depending on such factors as the power of the motor driving them, the strength of the cleaning solution used, and so on. The cleaning brushes may have a cylindrical shape, may be mounted vertically, and may engage the pool tiles during a rotational movement, as suggested in FIGS. 11, 12, 15, 16*a-b* and 17. The forward and aft cleaning brushes may be located in a way to maximize right angle corner cleaning contact points with the tile surface, by, for example, placing them in the respective corners of the robotic pool tile cleaning apparatus. The cleaning brushes 1270*a-d* may have a height of approximately 6 inches, plus or minus ½ inch. The example dimension does not include the shaft.

Figure 15:
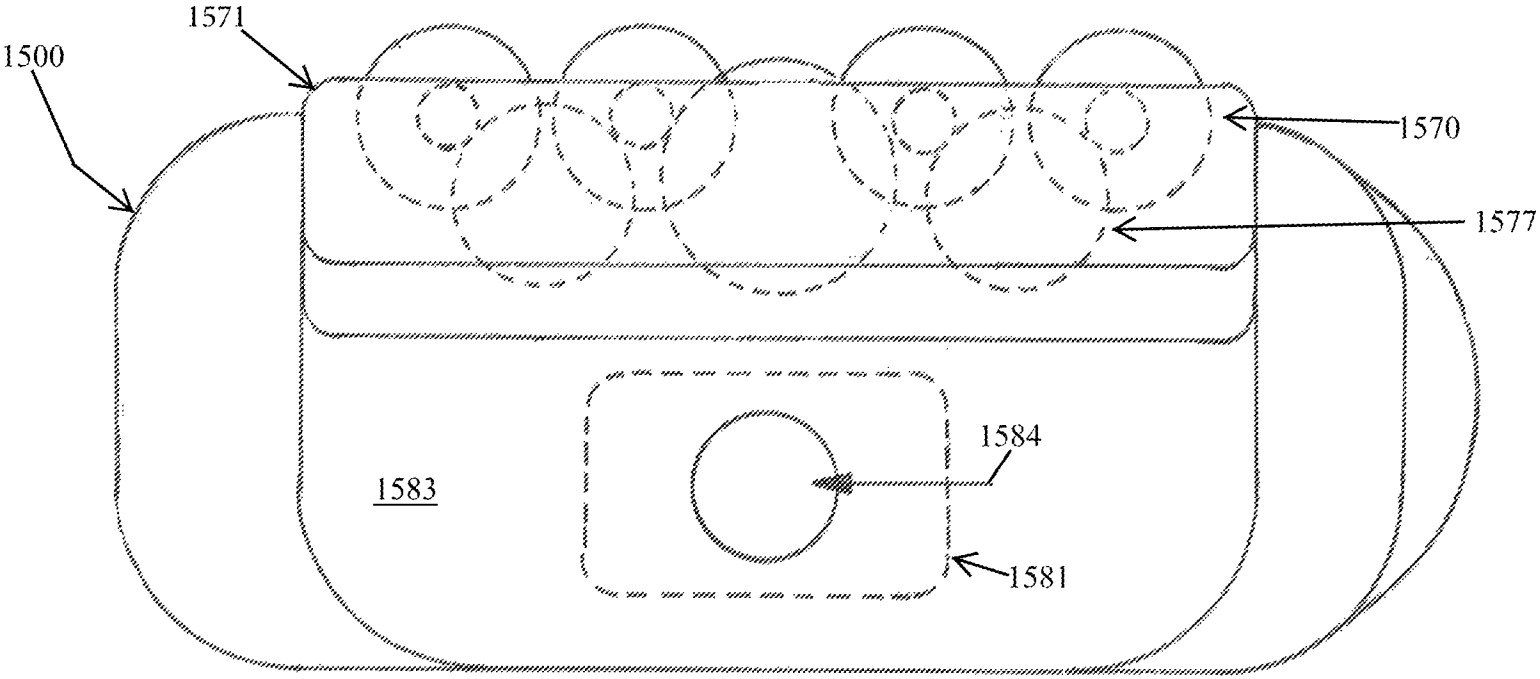
FIG. 15 illustrates a top view of a top cover assembly of the robotic pool tile cleaner, according to an aspect.

As shown in FIGS. 11 and 15, for proper operation, the cleaning brushes 1170 *a-b* would need to protrude out of an upper brush, timing belt and pulley cover 1371, 1571, as suggested by its left side (port) edge 1171 in FIG. 11.

As shown in FIGS. 11-12, the top shaft 1279*a* of the cleaning brushes will include a mounted timing gear pulley 1180, 1280 to receive the cleaning brush timing belt 1172 and thus the driving force for the cleaning brushes 1170*a-d* from the cleaning brush motor 1173. As shown, one vertically mounted drive motor 1173 can be used to drive all cleaning brushes at the same time. The drive motor 1173 may be a 12 Volt DC motor. The maximum wattage for this drive motor at 12 Volts DC may also be 55 watts @ 3,000 RPM. Lesser wattage motors and various RPM's are available and may be used. The minimum wattage required may be 24 watts at 12 Volts DC. Any wattage in between may be used, depending on manufacturer source and availability. The motor 1173 with may be equipped with a fabricated mechanical tensioner assembly 1129 the structure and function of which being similar to that of the tensioner described hereinbefore when referring to FIGS. 3-4. In this case as well, as with the other drive motors for the propeller/thrusters, an idler timing pulley (not shown) may be used in lieu of the motor mount tensioner assembly.

The top shaft 1279*a*, may be mounted into a top mounting plate 1274. The bottom shaft 1279*b* may be mounted into a bottom mounting plate 1275. The top and bottom shafts may be fitted into water-resistant dry-running sleeve bearings (not shown), which are readily available from various market sources. As an example, dimensional width of the bearings may be approximately 3 to 4 inches diameter. A wider diameter may allow for longer service life of the cleaning brushes.

Not shown, but likely a necessity will be a polycarbonate or equivalent plastic guard mounted on the back side of the cleaning brushes to protect the top section from water ingress.

The bottom plate 1275 may mount to, or be a part of the bottom section top plate (233 in FIG. 2), while the top plate 1274 may be mounted into place with double threaded standoffs (not shown). For example, a male thread (not shown) may be fitted into the bottom plate 1275 using pre-drilled and tapped fastener points (not shown). The top plate 1274 may have through-holes (not shown) with sufficient thread length for lock washer and hex nut. For sufficient rigidity, 3 (three) threaded standoffs are suggested; one on each end and one in the middle of the top and bottom plates.

FIGS. 15, 16*a-b* and 17 show an example of a transmission configuration for the cleaning brushes 1670*a-b*. As shown, a gear array 1577, 1677, 1777 could be used to transmit the driving force from the motor 1673 to the cleaning brush array 1670. An easier and likely more dependable method to drive the cleaning brushes is using a double teeth L-series timing belt 1172 in conjunction with timing belt pulleys 1180, 1280 (motor 1173 will have a similar time belt pulley 1180*a* to prevent slippage). As an example, the timing belt 1172 and pulleys 1180 may have a 0.375 inch pitch, and be ¼" wide. Again, a dimension is suggested, but it is subject to change and revision, the goal being to provide belt to cleaning brush contact with no slippage, for optimal efficiency of the cleaning brushes.

Referring to FIG. 16*a*, the top view illustration shows an example of counter rotation configuration for the cleaning brushes 1670*a-d*. Counter rotation is important for better cleaning efficiency of the cleaning brushes, and serves also as a "drag" feature to maintain consistent forward speed of the robotic pool tile apparatus. In the example shown, the back and front brushes 1670*a*, 1670*d* are rotating clockwise, while the inner brushes 1670 *b-c* are rotating counterclockwise. Other counter rotation configurations may be adopted, such as where cleaning brushes 1670*b* and 1670*d* are rotating clockwise, while 1670*a* and 1670*c* are rotating counterclockwise.

FIG. 13 illustrates a right side (starboard) view of equipment placed on an upper level of the pool tile cleaner, according to an aspect. A phantom line 1383 provides a conceptual side view look at the shape of a top cover assembly. Note the raised section 1371 of the cover behind the reservoir filler cap 1384. The raised section 1371 covers the brush cleaners, timing belt and timing belt pulleys.

The illustration from FIG. 13 gives an example of some equipment placement. It should be noted that in this example the equipment may placed onto a sublevel plate 1388, which may be fitted over the thrusters' motors described earlier, and which may be supported by four (for example) standoff supports 1387. The sub-level plate 1388 will fit to accommodate the area for drive motors on the top plate 233 between the upper and lower-immersed sections.

The basic equipment is a reservoir 1381 for storing the cleaning solution; most likely white vinegar is the best choice for optimum cleaning of swimming pool tile. Vinegar is benign in terms of mixing with pool water and chemicals ubiquitous in chlorine/salt treated bodies of water. The vinegar does however assist in the disintegration of calcium build up which occurs over time from hard water and high pH levels.

For example, and automotive windshield washer kit may be the least expensive source for the reservoir. Included in the kit is typically a reservoir with filler cap, an external pump motor, 12 Volt DC, two sprayers and the necessary tubing and related hardware.

Referring to the aft section 1380 for example, the electronics PLC (Programmable Logic Controller) for controlling the operation of the robotic pool tile cleaner as described herein, or imbedded controller, with possibly some relay logic may be fitted into this space 1380. The PLC or its substitute will be configured to control the operation of the robotic tile cleaner, as described in this disclosure, including its starting, stopping, timing, spraying and turning. In a simplified example, the PLC may be programmed as follows: first, to start the starboard thrusters and thus cause the robotic tile cleaner to approach and push against the tile wall; next the brushes will be started; next, or simultaneously with the brushes, spraying of the cleaning liquid will be started; next the aft thruster will be started to move the robotic cleaner forward; when the first pool corner is reached, all thrusters will be stopped, then aft and fore thrusters will be started to turn the robotic cleaner; after turning, the starboard thrusters will be started again, the fore thruster will be stopped and the aft thruster will be left running; same controls will be provided in each corner as in the first corner; when the robotic cleaner reaches the first corner again, cleaning may be considered completed and all thrusters, brushes and spraying will be stopped; this cleaning cycle can be repeated every 24 hours. All the inputs, outputs and programming may be located in this section, 1380. This section 1380 may be the CPU of the robotic pool tile cleaner.

The forward section 1382 may be reserved for 12 Volt DC batteries and charger. Lithium-ion battery may be the preferred choice, possibly more than one wired in parallel for longer run time. A 7 AH (amp hour) gel cell battery may be considered as well. Other type batteries may be used as alternates. A water tight battery receptacle with a removable cover (not shown may be installed on the shroud cover 1383.

A warning sticker (not shown) and/or instructions must be provided to remove the robotic pool tile cleaner from the swimming pool to recharge the battery. In any application for recharging the batteries, an external or internal battery charger should be plugged into a GFCI (Ground Fault Circuit Interrupter) receptacle. The battery charger should output 12 Volts DC nominal. The battery charger likely will input 120 Volts AC.

Figure 14:
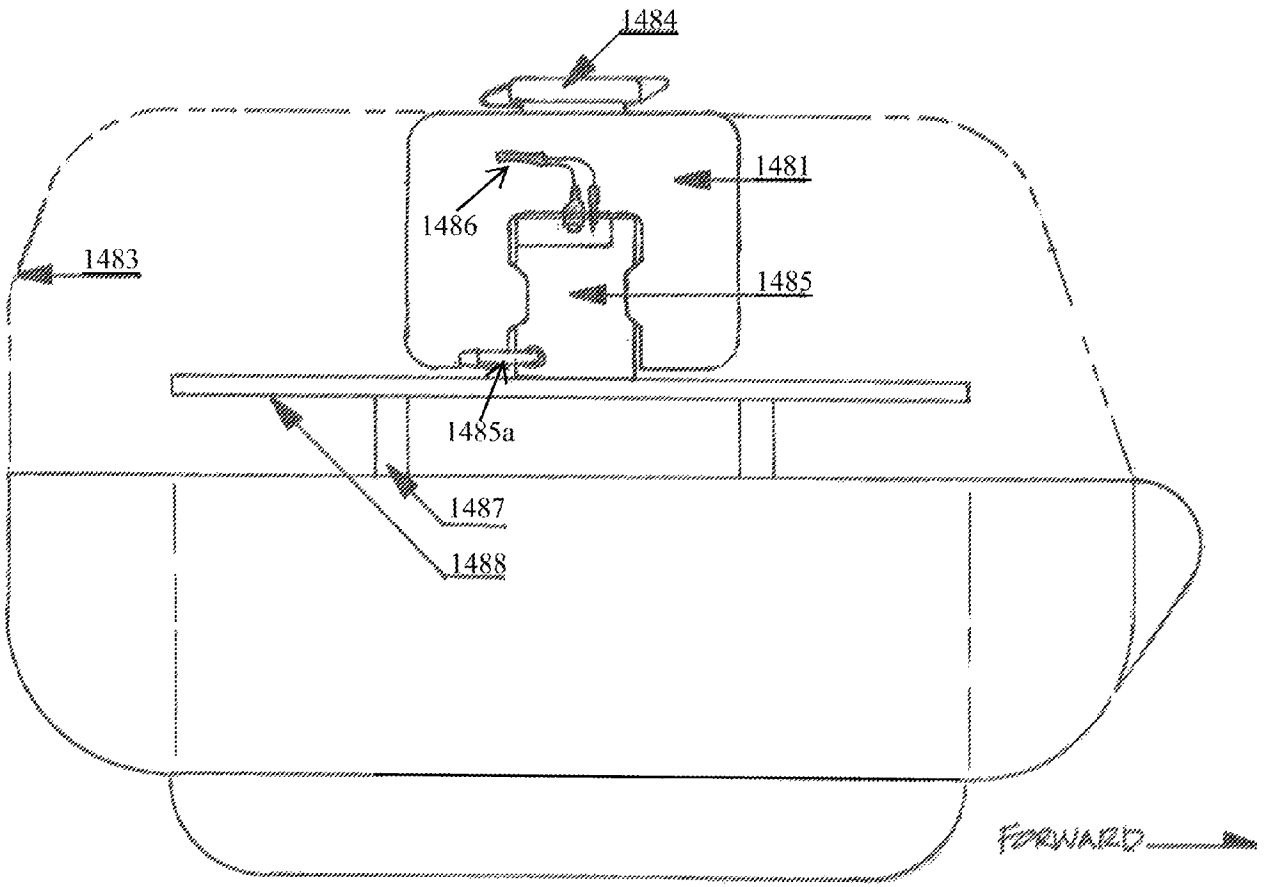
FIG. 14 illustrates additional details regarding the equipment depicted in FIG. 13.

FIG. 14 illustrates additional details regarding the equipment depicted in FIG. 13. As shown, the reservoir tank 1481 is typically fitted with an external pump motor 1485, 12 Volt DC type. The output barbed hose nozzle 1485*a* in this model is on the bottom left of the pump motor. The two wire leads 1486 of pump motor 1485 may be routed into the aft section controller area 1380 as an output device. The pump 1485 may be programmed to spray cleaning fluid (e.g., white vinegar), off the forward and aft port side of shroud cover 1383, 1483 onto the tile wall of the pool. Within the process, the pump may be programmed for example to spray for a short cycle or amount of time. Then the robotic pool tile cleaner may be programmed to proceed forward with the cleaning brushes rotating, as described hereinbefore. In an example, the approximate dimensions for a generic reservoir kit are 5.5 inches height×5.0 inches wide×4.0 inches deep.

FIG. 15 illustrates a top view of a top cover assembly of the robotic pool tile cleaner, according to an aspect. A conceptual drawing of the to cover assembly 1583 is dimensionally fitted to the bottom section 1500 of the robotic pool tile cleaner. For illustration purposes, the reservoir fill cap 1584 is shown. The reservoir fill cap 1584 is intended to be accessible for convenient cleaning solution refill. Again, white vinegar may be the selected cleaning solution for this application.

The left (port) top side 1571 of the cover 1583 may be raised and extends outward to cover the cleaning brushes 1570, timing pulleys and timing belts (or gears 1577, if a gear based transmission is used, as described earlier). FIG. 15 was drawn with a drive gear array 1577. However, as stated hereinbefore, a likely better, more practical solution has been determined to use a timing belt, both sides with belt teeth, and timing belt pulleys.

An alternate design may be to raise the entire top surface flush, still with an outward left side (port) "overhanging" to cover the cleaning brushes, timing pulleys, and timing belts.

It should be apparent from this disclosure that the robotic pool tile cleaner described herein is novel and unique dedicated swimming pool tile cleaner. It will be automated, thus will be able to run on a programmed course (e.g., twice around the pool tile wall in a cycle; one cycle a day) in a clockwise direction around swimming pools. It should be understood that while this disclosure focuses on a configuration of the robotic cleaner in which the robotic cleaner moves in a clockwise direction around the swimming pool, configurations including counterclockwise movement or both directions movement of the robotic cleaner may be adopted without departing from the scope of this invention.

The robotic swimming pool tile disclosed herein may be capable of starting and stopping on the swimming pool steps via a wobble stick micro switch 1335*a* (FIG. 13), or equivalent sensors, which will provide a "soft" stop. A "soft" stop inputs to the PLC (Programmable logic Controller), embedded controller or any related control, relay logic or CPU to signal a stop input. Upon an initial start, the wobble stick may be programmed to be time-delayed "off" with no input to the controller.

A momentary cleaner start/stop switch is a soft start and stop as well. A wireless remote may be used perform the same function for operation of the robotic pool tile cleaner.

For safety reasons, an "emergency stop" switch is recommended. The "emergency stop" is recommended to be a 22 mm push to lock, twist to release type. It is readily available on the market as well as "emergency stop" legend plates. The 22 mm is suggested as being a standard size used in industrial, commercial and select residential applications. Other water-tight sizes may be considered as well. "Water-tight" and "for outdoor use" is a term used for any controls, devices, fixtures, enclosures, covers and accessories used in a wet environment; a non-metallic switch is suitable for this application.

The "emergency stop" is a "hard stop" meaning all power is immediately disconnected from the power supply. All running components will immediately stop. An "emergency stop" switch is recommended to be mounted on the top cover/shroud 1383, in an easily accessible location.

A decal and instructions stating for example "CAUTION-NOT A TOY"_is recommended as well in a conspicuous location.

Moreover, the robotic pool tile cleaner is intended to be used with no one swimming in the pool. Ideally, swimming pool waves will be minimal and the robotic pool tile cleaner will work more efficiently in this instance.

A digital pH meter may be added as an accessory, mounted on the top cover in a convenient location. Many swimming pool owners don't take time to frequently check their pool water pH level. If the chemical balance is not correct, over time, costly repairs to the pool equipment will be needed.

As an option, a weighted docking station with a handle well above the water line may be set unto the top of a swimming pool step.

The docking station may be in place for the robotic cleaner to stop and prevent it from floating away from the swimming pool wall. The handle will be helpful in removing the robotic pool tile cleaner out of the swimming pool.

The robotic pool tile cleaner may be configured to operate by wireless remote, or a water-tight momentary 22 mm push button, N.O. (usually) "Normally Open" or "normally off" contacts, momentary action, push button manual start switch.

Again, in an example described hereinbefore, the robotic pool tile cleaner will perform tile cleaning in a clockwise direction inside the swimming pool. A PLC, Programmable Logic Controller, or embedded controller may be configured to use timing functions, sensors with other inputs to start, stop and turn the tile cleaner, spray the cleaning solution onto the tiles, and perform other functions and operations as described herein.

Basic theory of operation. As described hereinbefore, in an example, four counter-rotating port-left side brushes will clean the tile surface. Vinegar or other tile cleaning solution will be sprayed, fore and aft, using a spray device similar to an automotive generic windshield washer sprayer, in selected intervals. Submerged starboard-right side propellers will laterally push the cleaner against the tiles. An aft-rear propeller will drive the cleaner in a forward direction. A forward (bow, fore) propeller, will turn the tile cleaner in a perpendicular corner of a swimming pool, in conjunction with the aft propeller as described hereinbefore.

It may be advantageous to set forth definitions of certain words and phrases used in this patent document. Some known nautical terms were used herein (aft, bow, port, starboard, etc), since the robotic pool tile cleaner is also a robotic floating vessel. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A robotic swimming pool tile cleaner having a bottom section, an upper section extending upwards of the bottom section, a fore side, an opposite aft side, a port side and an opposite starboard side, the bottom section comprising a propeller housing adapted to house a first, a second, a third and a fourth thruster, all thrusters being configured to discharge water away from the propeller housing, the first thruster being positioned in an outer aft corner of the propeller housing to provide forward thrust to the robotic swimming pool tile cleaner, the second thruster being positioned in an opposite inner fore corner of the propeller housing and being configured to be turned on when the robotic swimming pool tile cleaner is in a corner of a swimming pool and thus assist in turning the robotic swimming pool tile cleaner therein by providing turning thrust for moving the fore side of the robotic swimming pool tile cleaner away from a swimming pool wall facing the fore side, the first and second thrusters being mounted non-coaxially and at a set angle in relation to an axis of the robotic swimming pool tile cleaner extending from the aft side to the fore side, the third and fourth thrusters being positioned in the starboard side to provide side thrust to push the robotic swimming pool tile cleaner against a swimming pool tile wall facing the port side, and a plurality of cleaning brushes mounted vertically on the port side of the upper section and being configured to touch the swimming pool tile wall facing the port side and to move during operation of the robotic swimming pool tile cleaner.

2. The robotic swimming pool tile cleaner of claim 1 wherein the set angle is about 45 degrees.

3. The robotic swimming pool tile cleaner of claim 2 wherein each of the plurality of cleaning brushes move rotationally.

4. The robotic swimming pool tile cleaner of claim 3 wherein the plurality of cleaning brushes is arranged in an array and wherein the plurality of cleaning brushes is configured to engage in a counter rotation movement by having at least a cleaning brush rotating clockwise and at least another cleaning brush rotating counterclockwise during operation of the robotic swimming pool tile cleaner.

5. The robotic swimming pool tile cleaner of claim 4 wherein the plurality of brushes is actuated using a drive system comprising a motor, a timing belt and a plurality of timing pulleys associated with the plurality of brushes.

6. The robotic swimming pool tile cleaner of claim 5 further comprising a belt tensioner.

7. The robotic swimming pool tile cleaner of claim 4 further comprising a spraying module including a reservoir and a pump, the spraying module being configured to store and spray a cleaning liquid onto the swimming pool tile wall facing the port side during operation of the robotic swimming pool tile cleaner.

8. The robotic swimming pool tile cleaner of claim 7 further comprising a plurality of inlets in the port side of the propeller housing for providing water to the first, the second, the third and the fourth thruster.

9. The robotic swimming pool tile cleaner of claim 8 wherein the third and fourth thrusters are mounted perpendicularly to the starboard side of the propeller housing.

10. The robotic swimming pool tile cleaner of claim 8 further comprising floats at a bottom of the propeller housing, for providing hydrodynamic stability of the robotic swimming pool tile cleaner.

11. The robotic swimming pool tile cleaner of claim 1 further comprising a rudder configured to turn to a normal position in which a discharge flow of the first thruster is forced to provide mostly forward thrust and a turn position in which the discharge flow of the first thruster provides forward thrust as well as side thrust and thus assist with the turning of the robotic swimming pool tile cleaner.

12. The robotic swimming pool tile cleaner of claim 1 wherein the third and fourth thrusters are configured to be turned off during the turning of the robotic swimming pool tile cleaner.

13. The robotic swimming pool tile cleaner of claim 1 wherein the robotic swimming pool tile cleaner is configured to engage in a clockwise movement around the swimming pool tile wall facing the port side of the robotic swimming pool tile cleaner.

14. A robotic swimming pool tile cleaner having a bottom section, an upper section extending upwards of the bottom section, a fore side, an opposite aft side, a port side and an opposite starboard side, the bottom section comprising a propeller housing adapted to house a first, a second, and at least a side thruster, all thrusters being configured to discharge water away from the propeller housing, the first thruster being positioned in an outer aft corner of the propeller housing to provide forward thrust to the robotic swimming pool tile cleaner, the second thruster being positioned in an opposite inner fore corner of the propeller housing and being configured to be turned on when the robotic swimming pool tile cleaner is in a corner of a swimming pool and thus assist in turning the robotic swimming pool tile cleaner therein by providing a turning thrust for moving the fore side of the robotic swimming pool tile cleaner away from a swimming pool wall facing the fore side, the first and second thrusters being mounted at a set angle in relation to an axis of the robotic swimming pool tile cleaner extending from the aft side to the fore side, the at least a side thruster being positioned in the starboard side to provide thrust for pushing the robotic swimming pool tile cleaner against a swimming pool tile wall facing the port side.

15. The robotic swimming pool tile cleaner of claim 14 further comprising at least a cleaning brush mounted vertically on the port side of the upper section and being configured to touch the swimming pool tile wall facing the port side and to move during operation of the robotic swimming pool tile cleaner.

16. The robotic swimming pool tile cleaner of claim 15 comprising a plurality of cleaning brushes arranged in an array and wherein the plurality of cleaning brushes is configured to engage in counter rotation movement by having at least a cleaning brush rotating clockwise and at least another cleaning brush rotating counterclockwise during operation of the robotic swimming pool tile cleaner.

17. A robotic swimming pool tile cleaner having a bottom section, an upper section extending upwards of the bottom section, a fore side, an opposite aft side, a port side and an opposite starboard side, the bottom section comprising a propeller housing adapted to house a plurality of thrusters being configured to provide forward thrust to the robotic swimming pool tile cleaner, assist in turning the robotic swimming pool tile cleaner in a corner of a swimming pool by providing a turning thrust to move the fore side of the robotic swimming pool tile cleaner away from a swimming pool wall facing the fore side, and to provide side thrust to push the robotic swimming pool tile cleaner against a swimming pool tile wall facing the port side, and a plurality of cleaning brushes mounted vertically on the port side of the upper section and being configured to touch the swimming pool tile wall and to move during operation of the robotic swimming pool tile cleaner.

18. The robotic swimming pool tile cleaner of claim 17 wherein the plurality of thrusters comprises a first, a second, a third and a fourth thruster, the first thruster being positioned in an outer aft corner of the propeller housing, the second thruster being positioned in an opposite inner fore corner of the propeller housing, the first and second thrusters being mounted at a set angle, for assisting in turning, in relation to an axis of the robotic swimming pool tile cleaner extending from the aft side to the fore side, the third and fourth thrusters being positioned in the starboard side of the propeller housing.

19. The robotic swimming pool tile cleaner of claim 18 wherein the set angle is about 45 degrees.

* * * * *